US007670159B2

(12) United States Patent
Shamoto et al.

(10) Patent No.: US 7,670,159 B2
(45) Date of Patent: Mar. 2, 2010

(54) LEVER-TYPE CONNECTOR AND CONNECTOR ASSEMBLY

(75) Inventors: Wataru Shamoto, Yokkaichi (JP); Kenji Makino, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/342,701

(22) Filed: Dec. 23, 2008

(65) Prior Publication Data

US 2009/0170358 A1 Jul. 2, 2009

(30) Foreign Application Priority Data

Dec. 28, 2007 (JP) ..... 2007-338516

(51) Int. Cl.
*H01R 13/62* (2006.01)

(52) U.S. Cl. ..... 439/157; 439/372

(58) Field of Classification Search ..... 439/157, 439/160, 372, 341
See application file for complete search history.

(56) References Cited

U.S. PATENT DOCUMENTS 5,873,745 A 2/1999 Duclos et al.
6,213,795 B1 * 4/2001 Drescher et al. ..... 439/157
6,796,815 B2 * 9/2004 Okabe et al. ..... 439/157
7,066,763 B1 6/2006 Corwin et al.
7,281,933 B1 * 10/2007 Shigeta et al. ..... 439/157
7,311,535 B2 * 12/2007 Taguchi et al. ..... 439/157
7,481,661 B2 * 1/2009 Takahashi et al. ..... 439/157
2006/0286834 A1 12/2006 Fukatsu et al.
2008/0081498 A1 4/2008 Fukatsu et al.

FOREIGN PATENT DOCUMENTS

DE 10332893 A1 2/2005
JP 2004-288442 10/2004

* cited by examiner

*Primary Examiner*—Xuong M Chung-Trans
(74) *Attorney, Agent, or Firm*—Gerald E. Hespos; Anthony J. Casella

(57) ABSTRACT

Two supports (24) are formed on one side surface of a first housing (20) at positions symmetrical to a center of a connection area with a second housing (40) in a lengthwise direction (L). The lever (60) is selectively mounted in a first mode on one of the two supports (24) and rotated toward one side or in a second mode on the other support (24) and rotated toward the other side. The lever (60) has a first and second parts for exerting pushing forces on the first housing (20) in a direction to proceed with a connecting operation of the housings (20, 40) as the lever (60) is rotated. The first part is a cam groove (68) engageable with a follower pin (43) of the second housing (40) and the second part is a recessed groove (73) engageable with the support (24) not supporting the lever (60).

10 Claims, 10 Drawing Sheets

LEVER-TYPE CONNECTOR AND CONNECTOR ASSEMBLY

BACKGROUND OF THE INVENTION

1. Field of the Invention

The invention relates to a lever-type connector and to a connector assembly and to a connecting method therefor.

2. Description of the Related Art

Japanese Unexamined Patent Publication No. 2004-288442 discloses a connector with first and second housings that are connectable with one another. A lever is supported rotatably on a support on a side surface of the first housing and a cam groove is formed in the lever. The cam groove can engage a follower pin that projects from the second housing. The follower pin slides on a surface of the cam groove as the lever is rotated to create a pressing force in a direction to assist a connecting operation of the two housings. As a result, the two housings are connected with each other with a small connecting force.

The support and the cam groove of the above-described connector are displaced toward one side from the longitudinal center of a connection area of the first housing. As a result, the connection of the housings tends to be delayed at a first longitudinal side as compared to the second longitudinal side, because the connecting force acts on the first longitudinal side of the connection area in a biased manner. Thus, the first housing may be distanced from a connecting surface of the second housing at the second longitudinal side when the connecting operation of the two housings is completed and contact margins between terminal fittings accommodated in the two housings may be insufficient at the second longitudinal side.

The invention was developed in view of the above situation and an object thereof is to ensure sufficient contact margins between terminal fittings by preventing a housing from becoming oblique.

SUMMARY OF THE INVENTION

The invention relates to a lever-type connector that has first and second housings that are connectable with one another. A lever is mounted on the first housing. First and second supports are formed on one side surface of the first housing. A lever can be mounted selectively on the first support in a first mode for rotation in a first direction. The lever also can be mounted selectively on the second support in a second mode for rotation in a second direction. The lever is formed with a first part and a second part for exerting pushing forces in a direction to connect the first and housings as the lever is displaced. The first part exerts the pushing force by engaging the second housing and the second part exerts the pushing force by engaging the support that does not support the lever.

The two supports preferably are formed on the side surface of the first housing at positions symmetrical with a center of a connection area with the second housing in a direction substantially orthogonal to a connecting direction.

The exertion of forces on the two supports assures that first housing is prevented from becoming oblique and assures that sufficient contact margins are assured between the terminal fittings in the two housings. Further, the first and second modes can be selected depending on the support on which the lever is mounted. Thus, the lever can be remounted to improve versatility. Further, the construction of the first housing can be simplified as compared with the case where a special engageable portion engageable with the second part is provided to prevent the housings from becoming oblique.

The second part preferably is engaged with the support after the first part is engaged with the second housing. Thus, an operation force does not drastically increase during a connecting operation of the two housings.

The support preferably is a projection, and the second part preferably is a groove and a back end of the groove pushes the support to prevent an oblique orientation of the first housing at a final stage of the rotation of the lever.

The second part preferably is a bottomed groove. Thus, the strength of the lever is higher as compared with the case of an open bottom.

The first part preferably is a cam groove and the second housing preferably has a plurality of follower pins located at positions substantially corresponding to the respective first and second modes for engaging the first part. The lever preferably has an escaping groove for receiving the follower pin that is not engaged with the first part. The entry of the follower pin into the escaping groove avoids interference between the lever and the follower pin. The escaping groove does not reduce the size of the lever significantly, and hence the lever is sufficiently strong.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
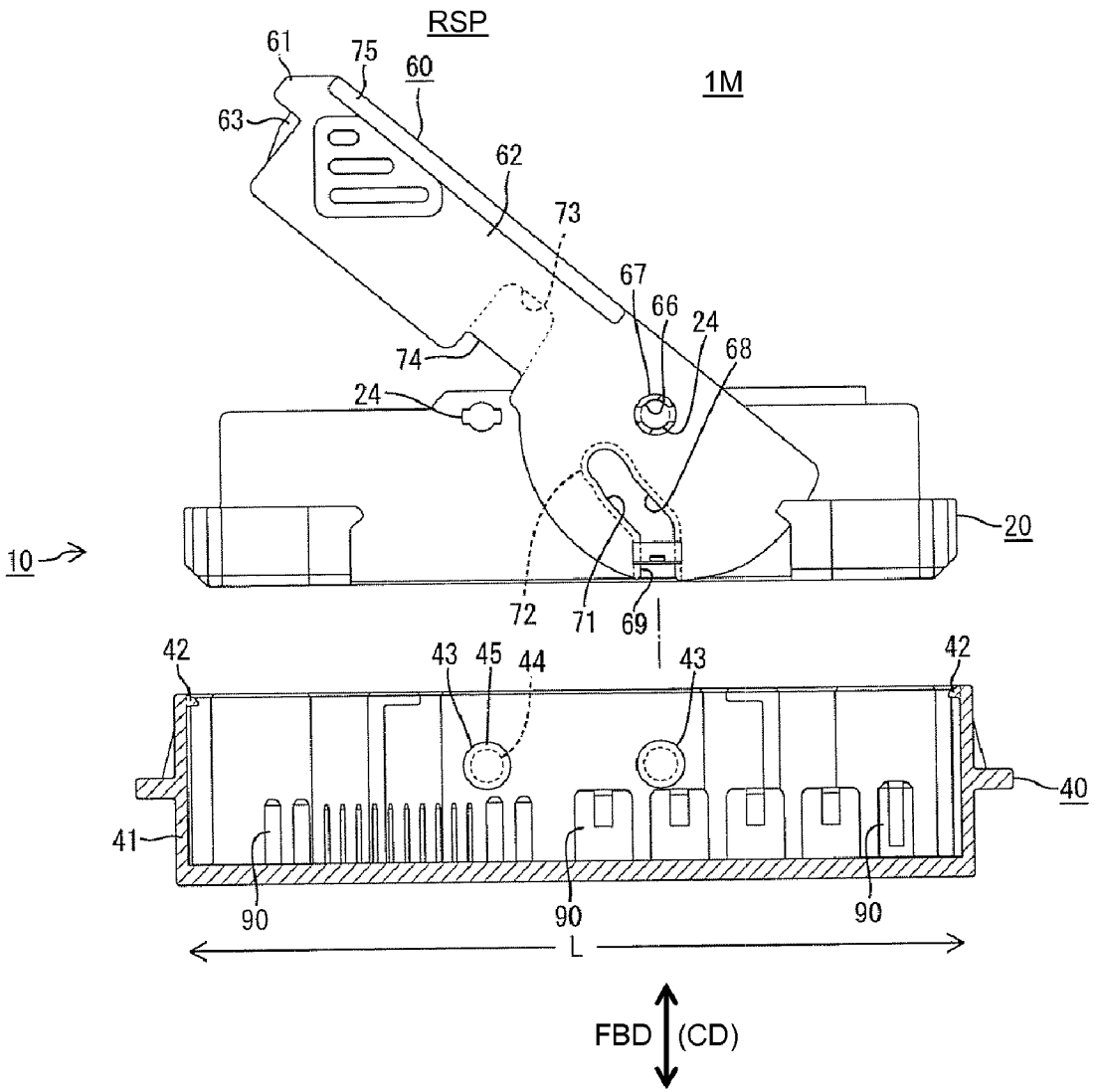
FIG. 1 is a side view partly in section showing a state before two housings are connected in a connector according to a first embodiment.
Figure 2:
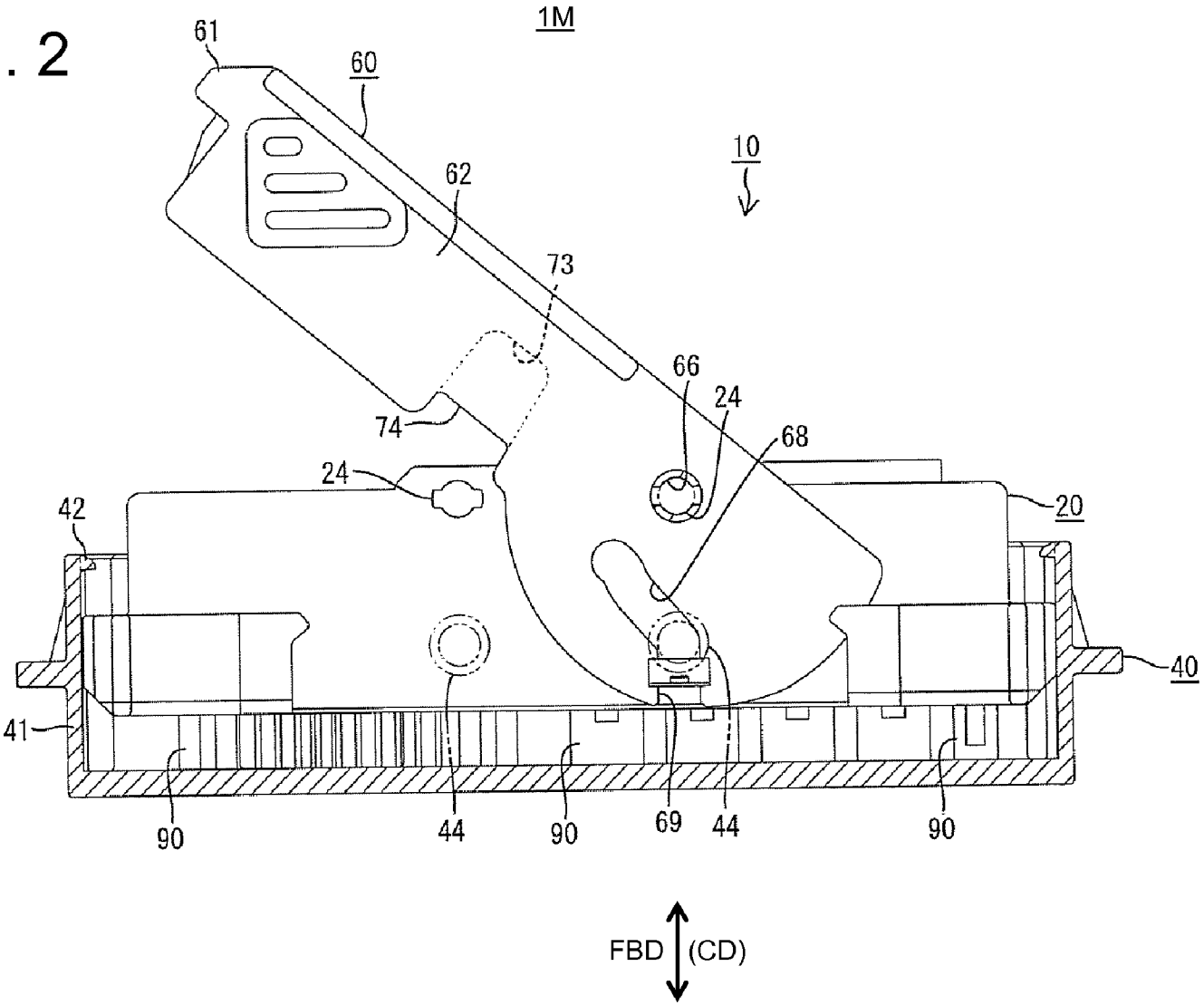
FIG. 2 is a side view partly in section showing a state where the two housings are partly connected.
Figure 3:
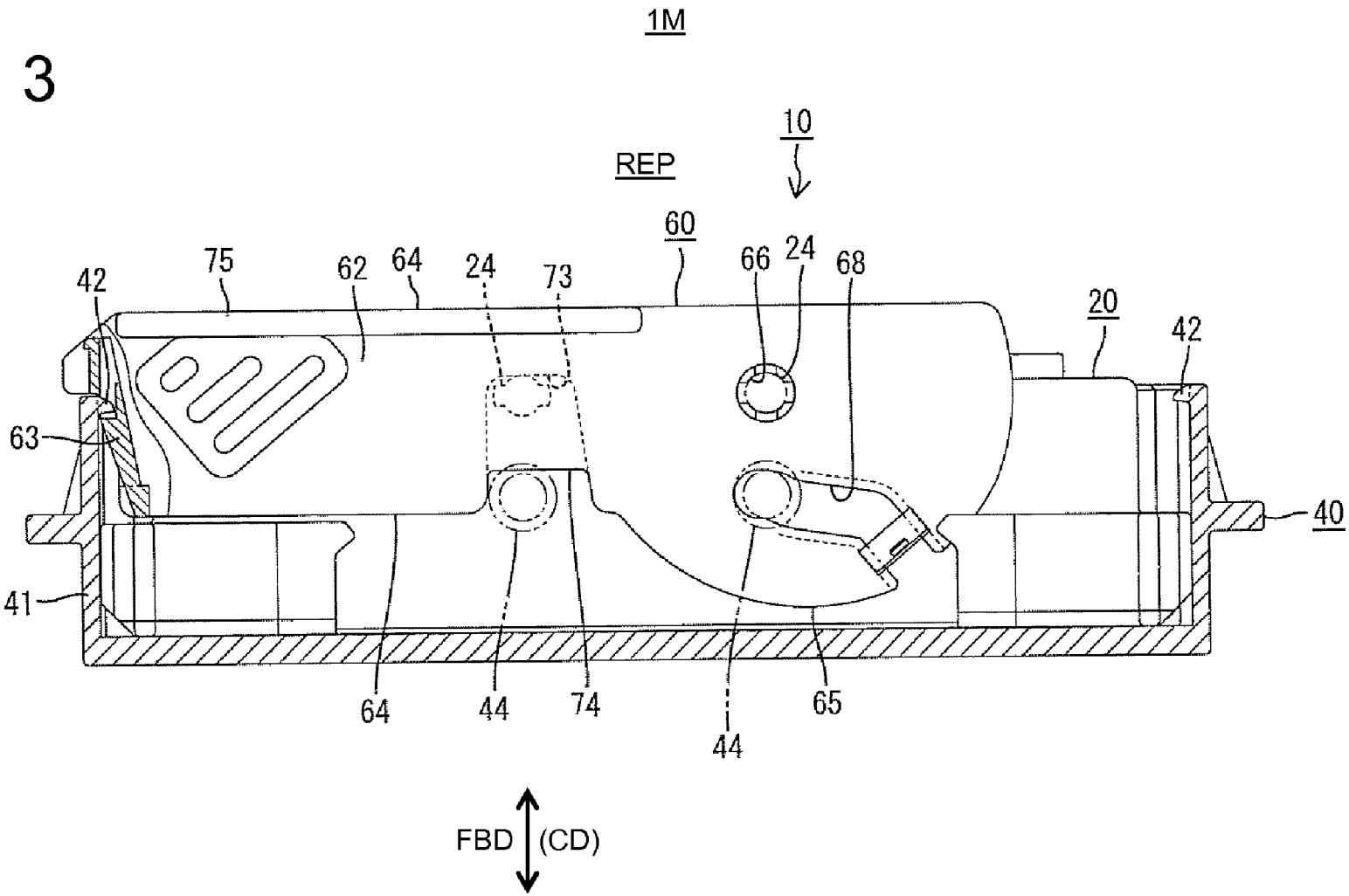
FIG. 3 is a side view partly in section showing a state where the two housings are properly connected.
Figure 4:
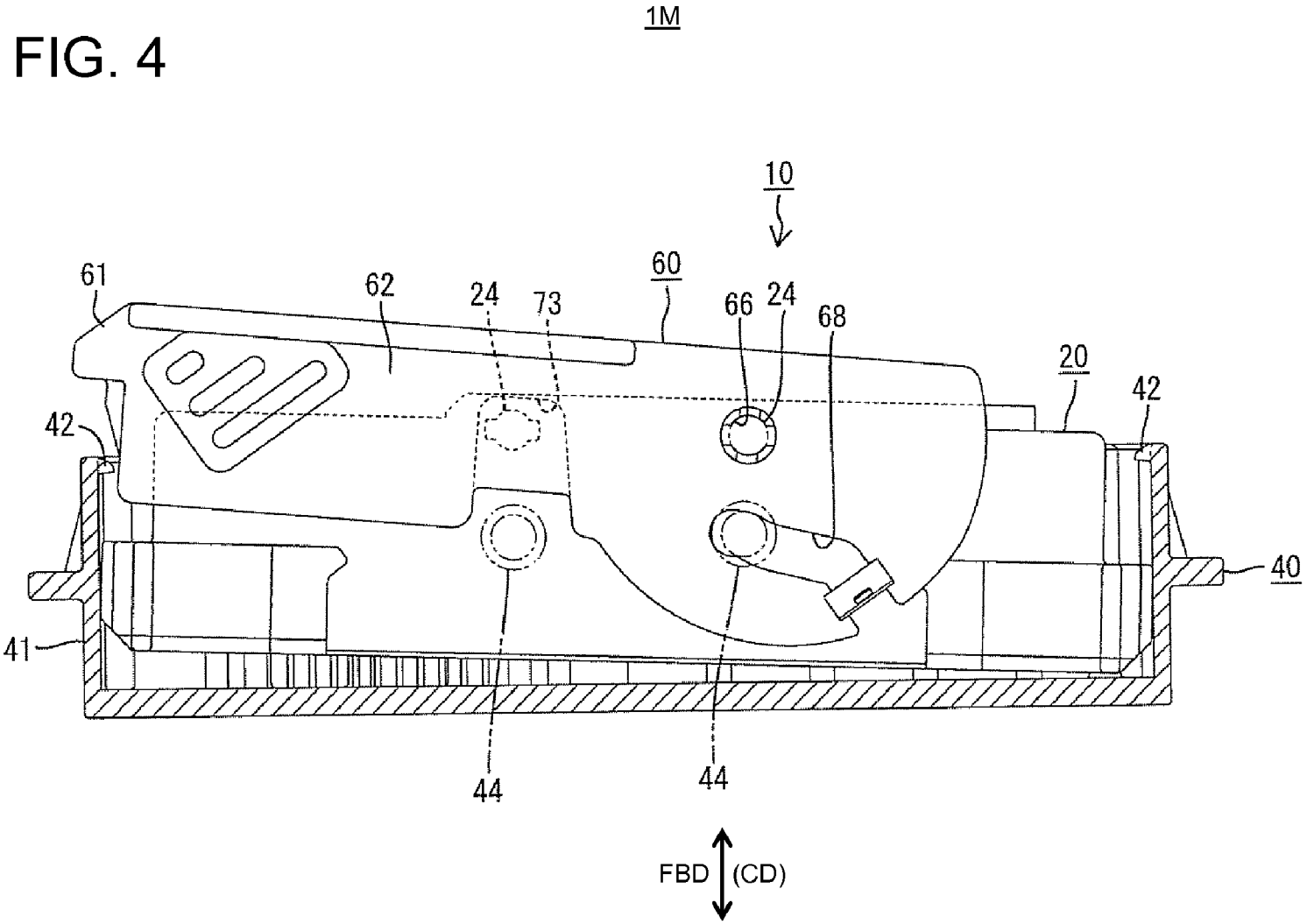
FIG. 4 is a side view partly in section showing a state where one side of the first housing is distanced.
Figure 5:
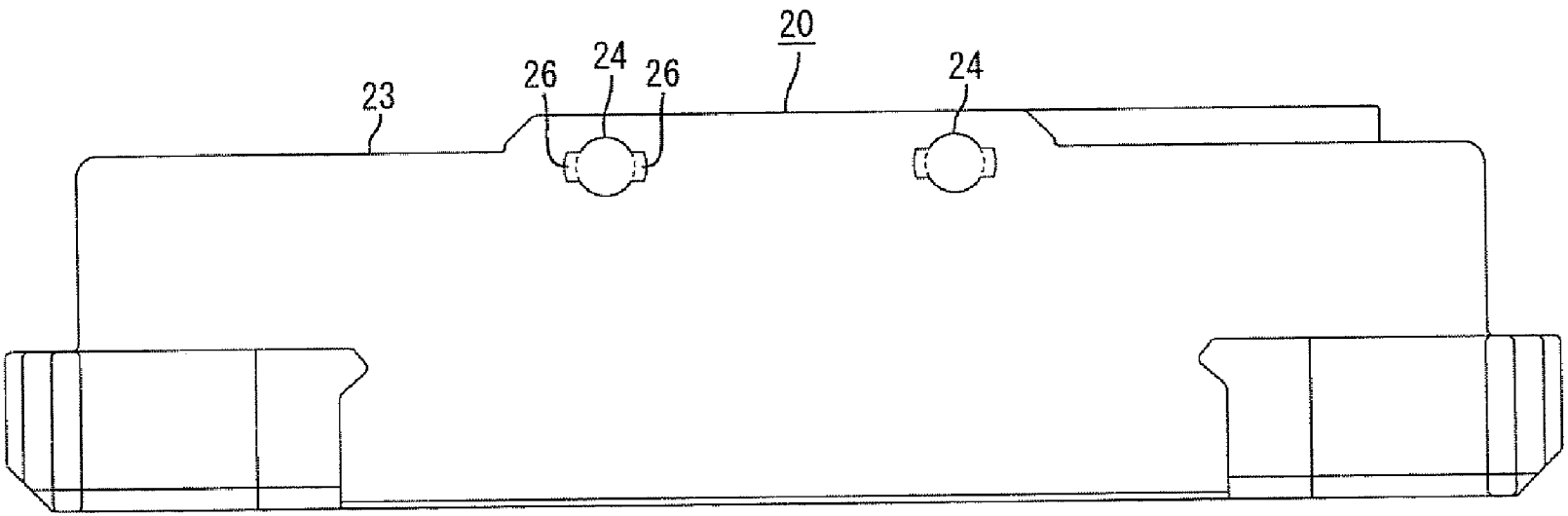
FIG. 5 is a side view of the first housing.
Figure 6:
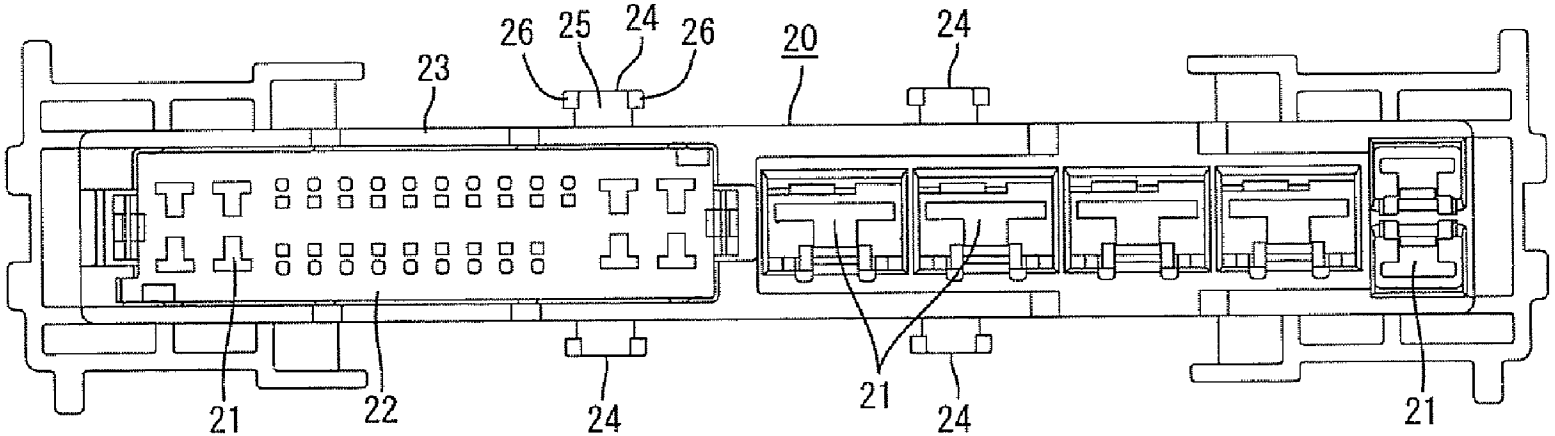
FIG. 6 is a front view of the first housing.
Figure 7:
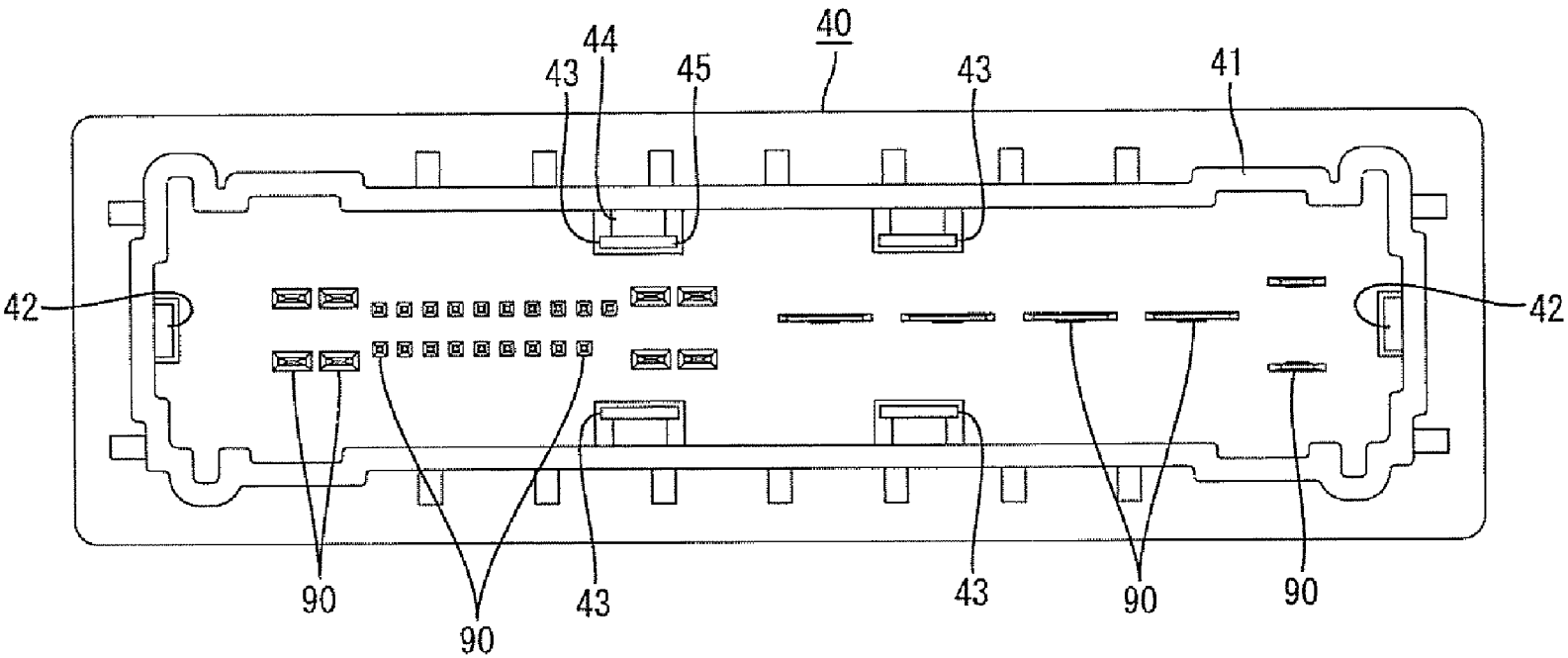
FIG. 7 is a front view of the second housing.
Figure 8:
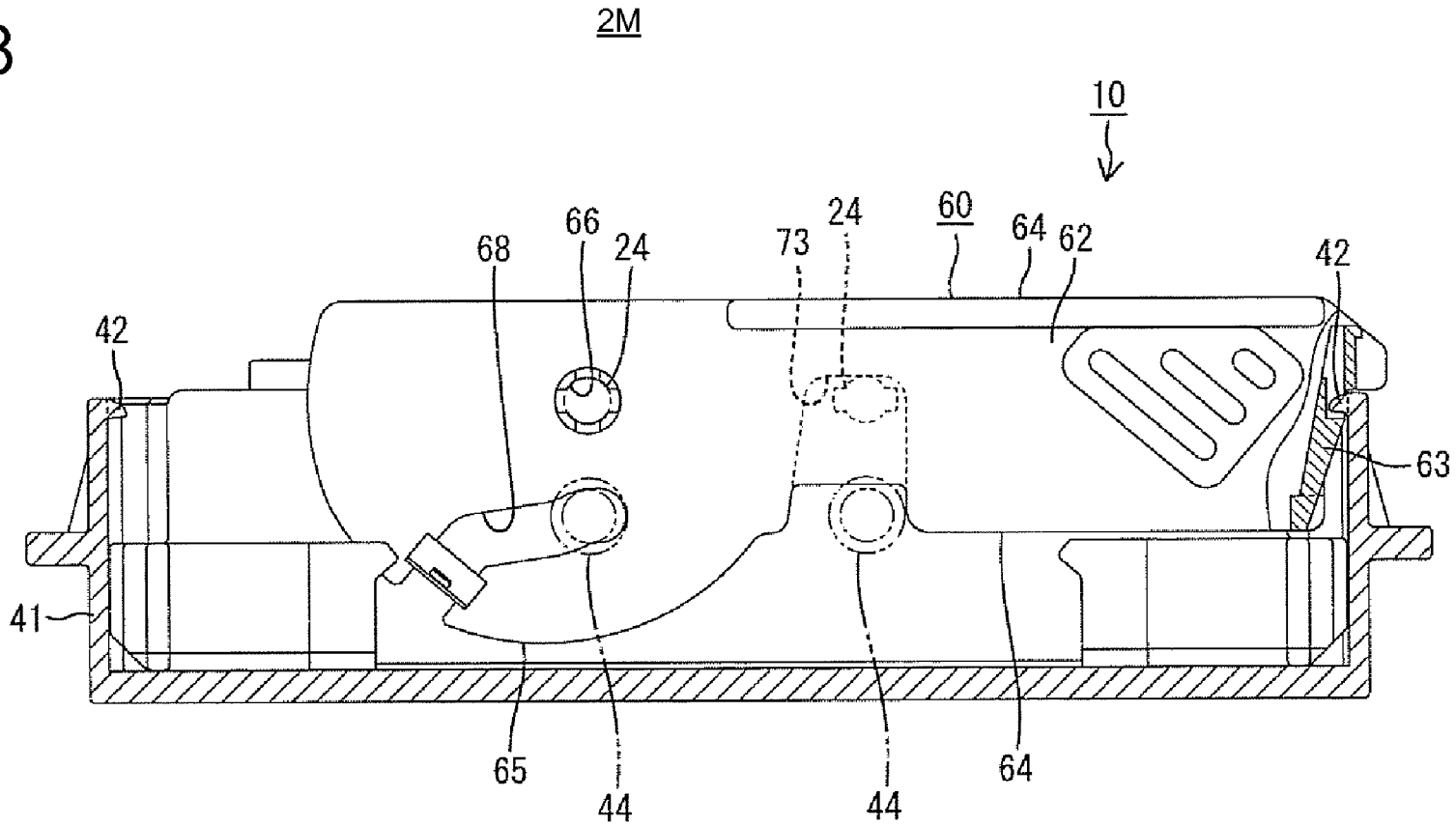
FIG. 8 is a side view partly in section showing a state where the two housings are properly connected in a different second mode.

A connector assembly in accordance with the invention is illustrated in FIGS. 1 to 8 and is identified generally by the numeral 10. The connector assembly 10 has a first housing 20 and a second housing 40 that are connectable with each other along a connecting direction CD. A lever 60 is mounted rotatably on the first housing 20. In the following description, ends of the two housings 20, 40 that are to be connected are referred to as front ends concerning forward and backward directions FBD, and the left side of FIG. 1 is referred to an upper side concerning a vertical direction.

The second housing 40 is made e.g. of synthetic resin and constructed as a male housing for receiving male terminal fittings. The second housing 40 includes a substantially rectangular tubular receptacle 41 that is long and narrow in a lengthwise direction L that is substantially orthogonal to a connecting direction CD. Large and small tabs 90 of male terminal fittings project into the receptacle 41 (see FIG. 7). Locks 42 are provided on the inner surfaces of the upper and lower walls of the receptacle 41 for retaining the lever 60 that has reached a rotation ending position REP. The locks 42 include claws that project in near the front end of the receptacle 41. The locks 42 are arranged at upper and lower positions to deal respectively with a first mode 1 M and a second mode 2M.

Upper and lower follower pins 43 project in from the inner surface of each of the opposite side walls of the receptacle 41 at a center of a connection area with the first housing 20 in the lengthwise direction L. The follower pins 43 are shaped and dimensioned identically and are arranged substantially symmetrically with respect to the center in the lengthwise direction L. Each follower pin 43 has a shaft 44 and a flange 45 that bulges out from the leading end of the shaft 44 over substantially the entire circumference.

The first housing 20 is made e.g. of synthetic resin and is constructed as a female housing that receives female terminal fittings. The first housing 20 includes a terminal accommodating portion 21 formed with cavities 21 for receiving the female terminal fittings and a frame 23 surrounding the terminal accommodating portion 22 (see FIG. 6). The frame 23 is long and narrow in the lengthwise direction L and is closely fittable into the receptacle 41. Upper and lower supports 24 project out at opposite sides of a center of a connection area with the second housing 40 in the lengthwise direction L at positions near the rear end of each of the opposite side walls of the frame 23 (see FIG. 5). The supports 24 are shaped and dimensioned identically and are arranged substantially symmetrically with respect to the center in the lengthwise direction L. Each support includes a shaft 25 and upper and lower projecting pieces 26 that project in the lengthwise direction L from positions near the leading end of the shaft 25.

The lever 60 also is made e.g. of synthetic resin and includes an operable portion 61 and two substantially parallel arms 62 that project from opposite ends of the operable portion 61 to define a substantially U-shape. However, the lever may define a plate-shape and may be insertable into an insertion space in the first housing 20. The lever 60 is mounted to straddle the first housing 20 from behind so that the arms 62 are arranged to face the outer sides of the opposite side walls of the frame 23. The operable portion 61 is distanced back from the frame 23 and the arms 62 are in oblique postures when the lever 60 is at a rotation starting position RSP (see FIG. 1). However, the lever 60 can be rotated to a rotation ending position REP where the operable portion 61 is at least partly accommodated in the receptacle 41 and the arms 62 are in postures substantially normal to the connecting direction CD (see FIG. 3). The operable portion 61 is formed with an interlocking portion 63 that is resiliently engageable with the locks 42 of the second housing 40.

The arms 62 are substantially identical and each arm 62 has front and rear straight edges 64 that are arranged substantially parallel with the length direction L of the first housing 20 when the lever 60 reaches the rotation ending position REP. Each arm 62 also has an arcuate edge 65 distant from the operable portion 61 and substantially facing the front end of the frame 23 when the lever 60 is at the rotation starting position RSP. Left and right ribs 75 are formed on the outer side surfaces of the arms 62 and extend along the rear straight edges 64. The arms 62 have engaging portions 66 between the straight edges 64 and the arcuate edges 65. The engaging portions 66 are engageable with the respective supports 24. The engaging portions 66 are in the form of key holes corresponding to the supports 24, and are engageable on the supports 24. Hooking edges 67 are recessed slightly around the hole edges and projecting pieces 26 slide on the hooking edges 67 to retain the arms 62.

The lever 60 is selectively mountable on the first housing in a first mode 1M (see FIGS. 1 to 4) where the engaging portions 66 are engaged with the lower supports 24 of the first housing 20 and the lever 60 is rotated up toward the rotation ending position REP and in a second mode 2M (see FIG. 8) where the engaging portions 66 engaged with the upper supports 24 of the first housing 20 and the lever 60 is rotated down toward the rotation ending position REP.

First and second parts are provided respectively at opposite sides of the engaging portion 66. The first part is more distant from the operable portion 61 than the second part. The first part is a cam groove 68 that can receive the follower pin 43. The cam groove 68 has an introduction opening 69 at the arcuate edge 65 for receiving the follower pin 43 at a partly connected position, and a cam groove main portion 71 extends from the back end of the introduction opening 69 to the vicinity of the engaging portion 66. The follower pins 43 are relatively displaceable along the cam grooves 68 and are pushed by the surfaces of the cam grooves 68 as the lever 60 is rotated to exert pushing forces that push the first housing 20 toward the second housing 40.

Engaging edges 72 are formed in the inner surfaces of the arms 62 around the cam grooves 68 and are slightly recessed from surrounding areas. The flanges 45 of the follower pins 43 slide on the engaging edges 72 during the rotation of the lever 60.

On the other hand, the second part is a bottomed recessed groove 73 formed in the inner surface of each arm 62 and is wider than the cam groove 68. The recessed grooves 73 extend in forward and backward directions FBD when the lever 60 is at the rotation ending position REP and open at the straight front edges 64 of the arms 62. The back ends of the recessed grooves 73 are substantially at the same positions as the engaging portions 66 with respect to forward and backward directions FBD when the lever 60 is at the rotation ending position REP. The supports 24 that are not supporting the lever 60 during the rotation of the lever 60, i.e. the upper supports 24 in the first mode 1M or the lower supports 24 in the second mode 2M, are fit loosely into the recessed grooves 73. The back end surfaces of the recessed grooves 73 push the supports 24 to exert pushing forces to the first housing 20 immediately before the lever 60 reaches the rotation ending position REP.

Escaping grooves 74 are formed at the front straight edges 64 of the lever 60 and can receive the follower pins 43 that are not engaged with the cam grooves 68 as the two housings 20, 40 are connected properly. The escaping grooves 74 are disposed to be continuous with the recessed grooves 73. The pin shafts 44 of the follower pins 43 enter the escaping grooves 74 while the flanges 45 of the follower pins 43 enter the recessed grooves 73 when the lever 60 reaches the rotation ending position REP and the two housings 20, 40 are connected properly.

Upon mounting the lever 60 on the first housing 20, the lever 60 is in an upright posture relative to the first housing 20 and, in this state, the supports 24 are inserted into the engaging portions 66. The lever 60 then is rotated to the rotation starting position RSP.

In the first mode 1M, the lever 60 is supported on the lower supports 24 of the first housing 20, and the upper supports 24 are left unengaged. The lever 60 is kept at the rotation starting position RSP so that the introduction openings 69 of the cam grooves 68 face the front end of the first housing 20 (see FIG. 1).

The two housings 20, 40 then are positioned opposed to each other and the first housing 20 is fit into the receptacle 41. Thus, the lower follower pins 43 of the second housing 40 enter the introduction openings 69 of the cam grooves 68 (see FIG. 2). The operable portion 61 then is gripped to rotate the lever 60 toward the rotation ending position REP. Accordingly, the follower pins 43 slide on the surfaces of the cam grooves 68 to exhibit a cam action and the unengaged supports 24 loosely enter the recessed grooves 73. The lock 42 and the interlocking portion 63 resiliently engage when the lever 60 reaches the rotation ending position REP to prevent rotation of the lever 60. Thus, the two housings 20, 40 are connected properly to connect the male and female terminal fittings in the housings 20, 40 electrically at proper depths (see FIG. 3). At this time, the follower pins 43 that are not engaged with the cam grooves 68 enter the escaping grooves 73 to avoid the interference with the straight edges 64 of the lever 60.

In the case of the connector 10 in the first mode 1M, the first housing 20 may be distanced from the back surface of the receptacle 41 at the upper side in the lengthwise direction L to become oblique and the terminal fittings may be connected lightly at this upper side in the lengthwise direction L because the supports 24 and the cam grooves 68 that support the lever 60 are displaced toward lower side of the first housing 20 in the lengthwise direction L. However, in the case of this embodiment, if the upper side of the first housing 20 in the lengthwise direction L is distanced (see FIG. 4) at the time of properly connecting the two housings 20, 40, the back surfaces of the recessed grooves 73 push the unengaged upper supports 24 forward immediately before the lever 60 reaches the rotation ending position REP for exerting pushing forces on the first housing 20. Thus, the distanced upper side of the first housing 20 in the lengthwise direction L is moved to correct the posture of the first housing 20. Accordingly, the two housings 20, 40 are held right across from each other entirely in the lengthwise direction L when the housings 20, 40 have reached proper connection positions to prevent the terminal fittings from being left lightly connected.

The lever 60 also can be remounted in the second mode 2M if peripheral parts are near the upper side of the first housing 20 in the lengthwise direction L and the lever 60 cannot be rotated to the other side in the lengthwise direction L.

In the second mode 2M, the lever 60 is supported by the upper supports 24 of the first housing 20 and the lower supporting portions 24 are left unengaged. The lever 60 then is rotated in a direction opposite to the one described above, the lower supports 24 enter the recessed grooves 73 of the lever 60 and the back surfaces of the recessed grooves 73 push the lower supports 24. Thus, pushing forces for preventing the first housing 20 from becoming oblique are exerted substantially in the same manner as described above and the two housings 20, 40 are connected with each other in proper postures (see FIG. 8).

As described above, the supports 24 are provided in pairs at positions substantially symmetrical with respect to the center of the connection area of the first housing 20 in the lengthwise direction L. Thus, pushing forces are exerted on the first housing 20 from one side in the lengthwise direction L by the engagement of the follower pins 43 of the second housing 40 with the cam grooves 68 of the cover 60 as the lever 60 is rotated, and the supports 24 unengaged with the lever 60 engage with the recessed grooves 73 of the lever 60 to exert pushing forces on the first housing 20 from the other side in the lengthwise direction L. Therefore, well-balanced pushing forces are exerted on the first housing 20. As a result, the first housing 20 is prevented from becoming oblique and the terminal fittings in the two housings 20, 40 are prevented from being connected with insufficient contact margins. Further, the first and second modes 1M and 2M can be used selectively depending on which two of the supports 24 the lever 60 is supported. The lever 60 can be remounted to improve versatility. In addition, the supports 24 that do not support the lever 60 engage the recessed grooves 73 to prevent the first housing 20 from becoming oblique. Thus, the construction of the first housing 20 can be simplified as compared with the case where special engageable portions engageable with the recessed grooves 73 are provided in place of the supports 24.

The recessed grooves 73 are engaged with the supports 24 after the cam grooves 68 engage the follower pins 43 of the second housing 40. Thus, the operation force does not drastically increase during the connecting operation of the two housings 20, 40.

The recessed grooves 73 are bottomed to improve the strength of the lever 60 as compared with the case of open bottoms.

Mutual interference of the lever 60 and the follower pins 43 is avoided by the entrance of the follower pins 43 into the escaping grooves 74. The escaping grooves 74 are formed partially in the lever 60. Thus, the lever 60 does not become very much smaller and remains strong.

Figure 9:
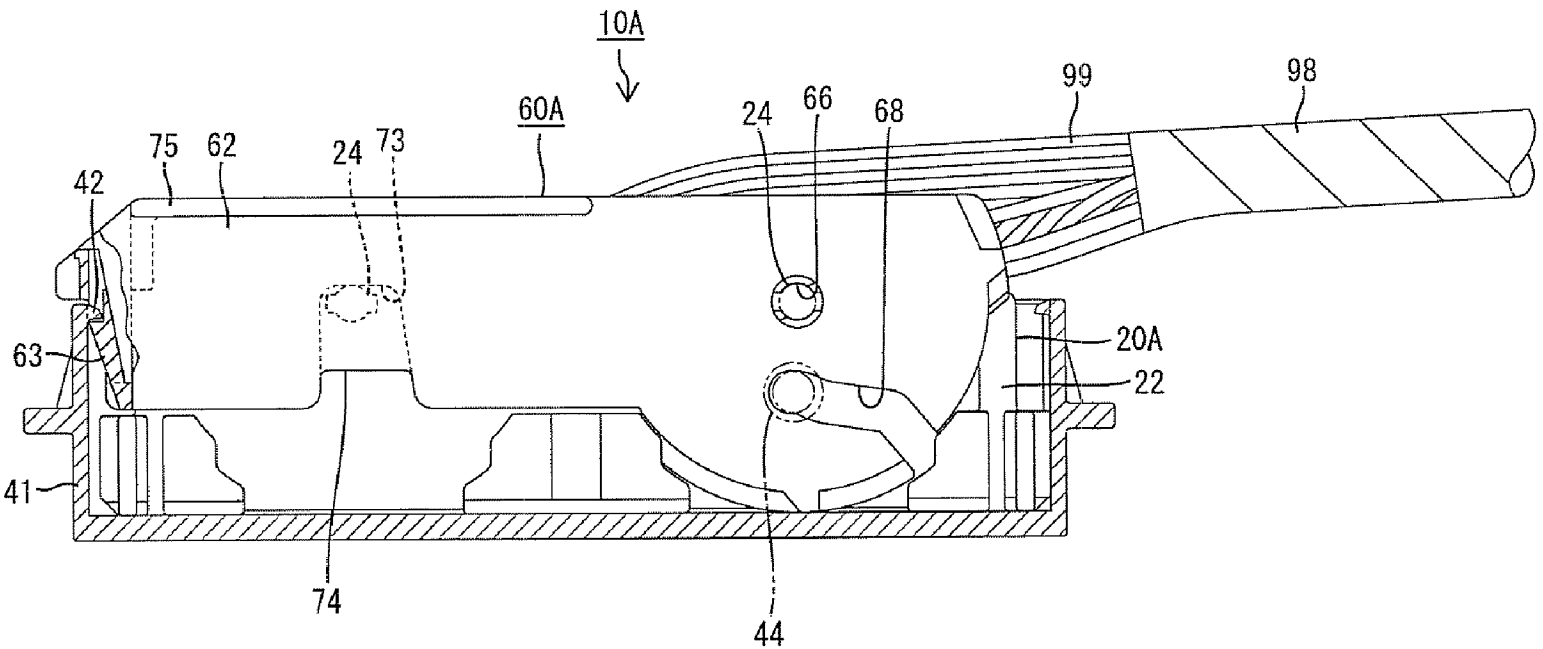
FIG. 9 is a side view partly in section showing a state where two housings are properly connected in a connector according to a second embodiment.
Figure 10:
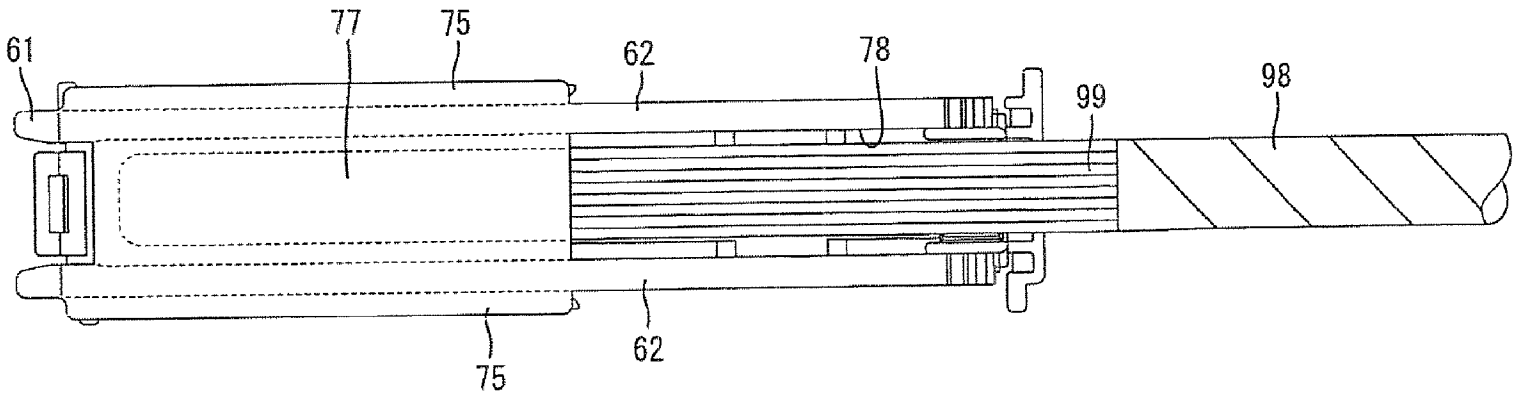
FIG. 10 is a rear view of the first housing when a lever reaches a rotation ending position.

A second embodiment of the invention is described with reference to FIGS. 9 and 10. A connector 10A of the second embodiment is common to the first embodiment in that upper and lower supports 24 are formed on each of the opposite outer side surfaces of a first housing 20A and that a lever 60 is formed with cam grooves 63 as first parts and recessed grooves 73 as second parts. However, the second embodiment differs from the first embodiment in that a rear plate 77 connects the rear ends of two arms 62 of the lever 60.

The rear plate 77 is arranged to cover the rear surface of the lever 60 from the connected positions of the rear ends of the arm portions 62 with an operable portion 61 to positions slightly beyond centers of the arms 62 in a lengthwise direction L. The rear end of the rear plate 77 is at substantially the same position as the rear ends of ribs 75. Further, an opening 78 is defined at the rear end of the lever 60 between the two arms 62 at a side opposite to the rear plate 77. The first housing 20A includes a housing main body 29 capable of accommodating female terminal fittings and wires 99 connected with the respective female terminal fittings are drawn out from the rear surface of the housing main body 29. The wires 29 are fixed and bundled by a tape 98 outside the first housing 20A.

Here, if the lever 60 reaches a rotation ending position REP, a group of the wires 99 drawn out from the rear surface of the first housing 20A is pressed by the rear plate 77 and drawn out through the open portion 78 of the lever 60. This group of the wires 99 is drawn out in a direction opposite to a rotating direction of the lever 60 (see FIG. 9). Thus, according to the second embodiment, a conventional wire cover for specifying a draw-out direction of the wires 99 by mounted on the rear part of the housing main body 29 is not necessary. Thus, costs are reduced and an operation step of mounting the wire cover is omitted to reduce an operation burden.

The invention is not limited to the above described and illustrated embodiments. For example, the following embodiments are also embraced by the technical scope of the present invention.

The first part may not be the cam groove and may be a force multiplying mechanism utilizing a rack and a pinion or leverage provided between the lever and the second housing.

The shape of the second part is not particularly limited provided that the second part pushes the supporting portion to exert a pushing force to the first housing as the lever is rotated. For example, the second part may be merely the straight edge of the arm portion.

The escaping grooves may be formed at positions displaced from the recessed grooves or may be omitted depending on cases.

The lever may be in the form of one plate. In this case, only one pair of supporting portions may be formed on one side surface of the housing.

It should be understood that the lever may be displaceable along any suitable path such as a substantially linear path (like a slider), along an elliptic path or the like.

What is claimed is:

1. A lever-type connector, comprising:

a first housing connectable with a second housing, the first housing having a side surface, first and second supports formed on the side surface; and a lever being selectively mountable on the first support of the housing in a first mode for rotation about the first support in a first rotational direction and toward the second support, the lever further being selectively mountable on the second support of the first housing in a second mode for rotation about the second support in a second rotational direction substantially opposite the first rotational direction and toward the first support, the lever being formed with a first part disposed and configured for exerting a pushing force on the second housing toward the first housing in response to rotation of the lever and a second part disposed and configured for exerting a pushing force on the first support toward the second housing in response to rotation of the lever about the second support when the lever is mounted on the second support, the second part further being disposed and configured for exerting a pushing force on the second support toward the second housing in response to rotation of the lever about the first support when the lever is mounted on the first support.

2. The lever-type connector of claim 1, wherein the two supports are formed at positions symmetrical with a center of a connection area with the second housing in a lengthwise direction that is substantially orthogonal to a connecting direction.

3. The lever-type connector of claim 2, wherein the second part is disposed to engage one of the first and second supports after the first part is engaged with the second housing.

4. The lever-type connector of claim 1, wherein the first and second supports are projections, and the second part is a groove having a back end that pushes one of the first and second supports.

5. The lever-type connector of claim 4, wherein the groove is a bottomed groove.

6. The lever-type connector of claim 1, wherein the first part is a cam groove, the second housing having a first follower pin engageable with the cam groove when the lever is in the first mode and a second follower pin engageable with the cam groove when the lever is in the second mode, and the lever being formed with an escaping groove for receiving the follower pin that is not engaged with the cam groove.

7. A connector assembly comprising:

a first housing having a side surface, first and second supports formed on the side surface;

a second housing connectable with the first housing; and a lever being selectively mountable on the first support of the housing in a first mode for rotation about the first support in a first rotational direction and toward the second support, the lever further being selectively mountable on the second support of the first housing in a second mode for rotation about the second support in a second rotational direction substantially opposite the first rotational direction and toward the first support, the lever being formed with a first part disposed and configured for exerting a pushing force on the second housing toward the first housing in response to rotation of the lever and a second part disposed and configured for exerting a pushing force on the first support toward the second housing in response to rotation of the lever about the second support when the lever is mounted on the second support, the second part further being disposed and configured for exerting a pushing force on the second support toward the second housing in response to rotation of the lever about the first support when the lever is mounted on the first support.

8. The connector assembly of claim 7, wherein the first part is a cam groove, the second housing having a first follower pin engageable with the cam groove when the lever is in the first mode and a second follower pin engageable with the cam groove when the lever is in the second mode, and the lever being formed with an escaping groove for receiving the follower pin that is not engaged with the cam groove.

9. The connector assembly of claim 8, wherein the two supports are formed at positions symmetrical with a center of a connection area with the second housing in a lengthwise direction that is substantially orthogonal to a connecting direction.

10. The connector assembly of claim 7, wherein the second part is disposed to engage one of the first and second supports after the first part is engaged with the second housing.

* * * * *